US005127178A

United States Patent [19]

Sinclair

[11] Patent Number: 5,127,178

[45] Date of Patent: Jul. 7, 1992

[54] CARTRIDGE MAGAZINE

[76] Inventor: William P. Sinclair, 46 Westbury Road, Edington, Westbury, Wiltshire BA13 4PG, United Kingdom

[21] Appl. No.: 517,939

[22] Filed: May 2, 1990

[30] Foreign Application Priority Data

May 15, 1989 [GB] United Kingdom ..... 8911067
Nov. 17, 1989 [GB] United Kingdom ..... 8926014

[51] Int. Cl.[5] ..... F41A 9/82

[52] U.S. Cl. ..... 42/87; 221/92; 224/196; 224/253

[58] Field of Search ..... 42/87; 89/34; 206/3; 221/67, 92; 224/196, 203, 253

[56] References Cited

U.S. PATENT DOCUMENTS

| | | | |
|---|---|---|---|
| 90,634 | 6/1869 | Buffington | 206/3 |
| 162,481 | 4/1875 | Lee | 206/3 |
| 278,980 | 6/1883 | Livermore et al. | 224/196 |
| 340,732 | 4/1886 | Quilliam | 206/3 |
| 719,808 | 2/1903 | Johnson | 42/87 |
| 2,365,392 | 12/1944 | Cooley | 89/34 |
| 3,248,007 | 4/1966 | Hulterstrum | 221/67 |
| 4,180,192 | 2/1979 | Breslau | 224/196 |

FOREIGN PATENT DOCUMENTS

| | | | |
|---|---|---|---|
| 912583 | 8/1946 | France | 89/34 |
| 536728 | 5/1941 | United Kingdom | 89/34 |
| 577857 | 6/1946 | United Kingdom . | |
| 584743 | 1/1947 | United Kingdom . | |
| 616909 | 1/1949 | United Kingdom . | |
| 626110 | 7/1949 | United Kingdom | 89/34 |
| 965197 | 7/1964 | United Kingdom . | |

*Primary Examiner*—Stephen C. Bentley
*Attorney, Agent, or Firm*—Wood, Phillips, Van Santen, Hoffman & Ertel

[57] ABSTRACT

There is disclosed a magazine for holding cartridges such as shot gun cartridges, the magazine having, in a preferred embodiment, two channels (6,7) which are separated by a partition (8) and each of which can hold two staggered columns of cartridges (9). The partition (8) has a widened portion (10) that causes each staggered column of cartridges (9) to form a single column thereof, so that pairs of cartridges can be removed, to be immediately replaced, under the effect of gravity, by a further pair thereof.

9 Claims, 7 Drawing Sheets

CARTRIDGE MAGAZINE

This invention relates to a magazine for holding cartridges, such as shot gun cartridges, in a manner such that each cartridge is fed, under the influence of gravity, to a position from which it can be removed from the magazine to be immediately replaced at the same position by a subsequent gravity-fed cartridge.

According to the present invention, there is provided a cartridge magazine comprising one or two or more elongated channels each suitable to hold a column of cartridges or a plurality of staggered columns of cartridges in a manner such that, when one end of the elongated channel(s) is in an upper position and the other end of the elongated channel(s) is in a lower position, the cartridges can move towards the lower end under the effect of gravity upon removal of a cartridge from the lower end.

Preferably, the or each channel is suitable to hold two or more staggered columns of cartridges, and is tapered at the lower end to cause the cartridges to form a single column at the lower end. Preferably the magazine has two channels that veer towards each other at the lower end.

Preferably, the magazine comprises a box-like structure divided into said two channels by a partition having at its lower end a widening portion that forms said necks.

The invention will now be described, by way of example, with reference to the drawings in which.

Figure 1:
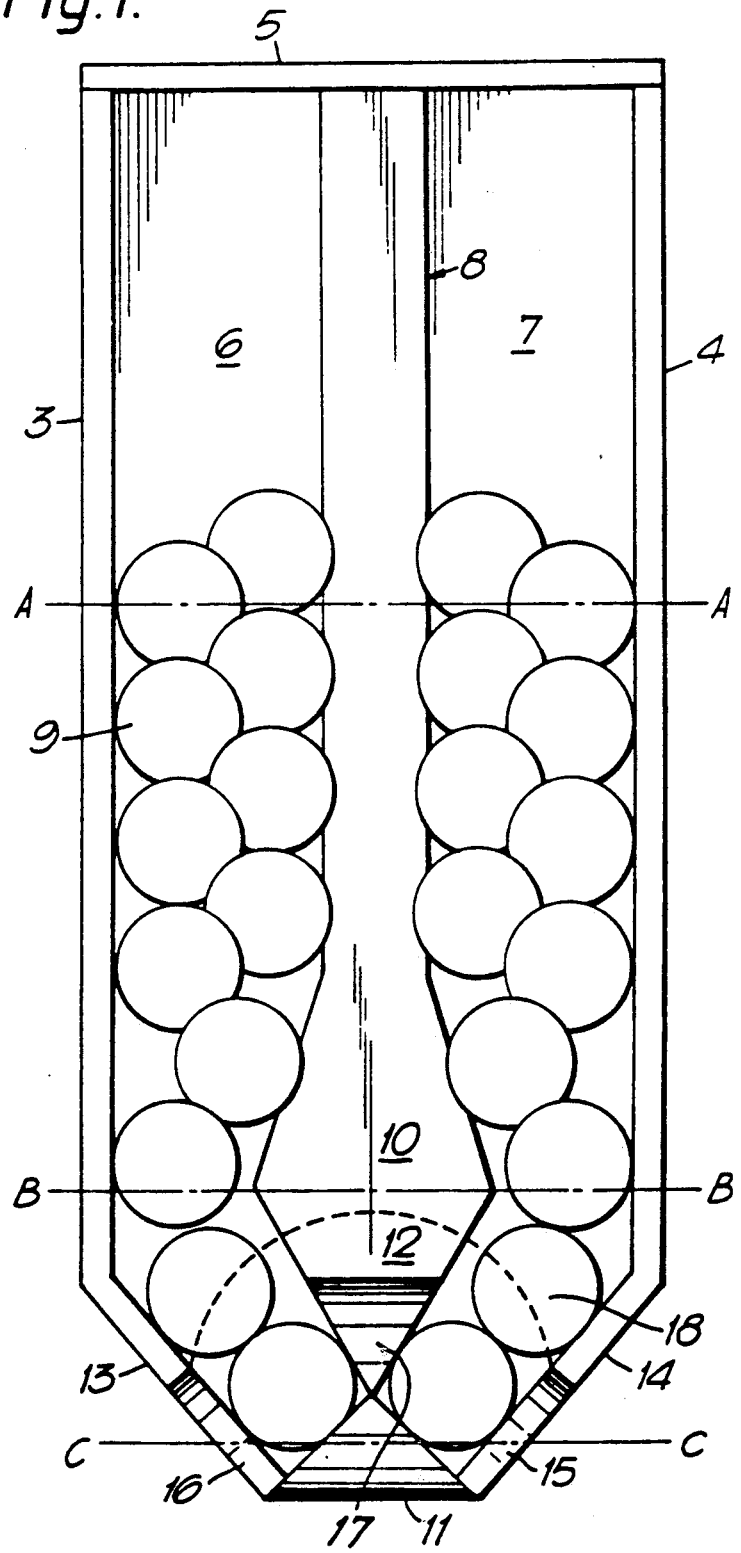
FIG. 1 is a plan view of a magazine of the invention.
Figure 2A:
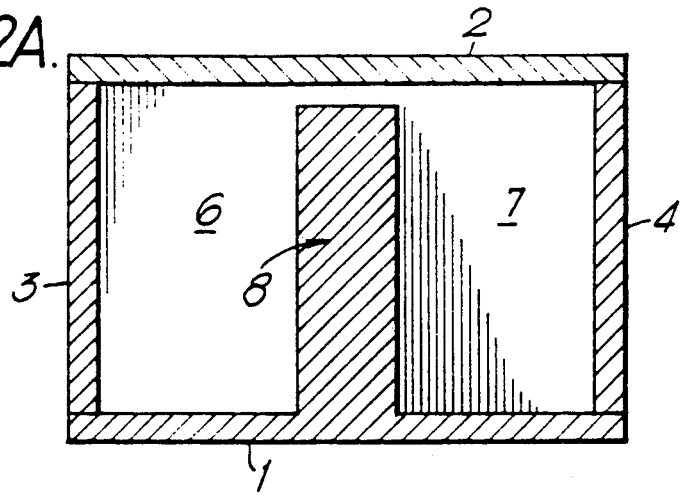
FIGS. 2A, 2B and 2C are sectional views taken along lines A—A, B—B and C—C of FIG. 1.
Figure 2B:
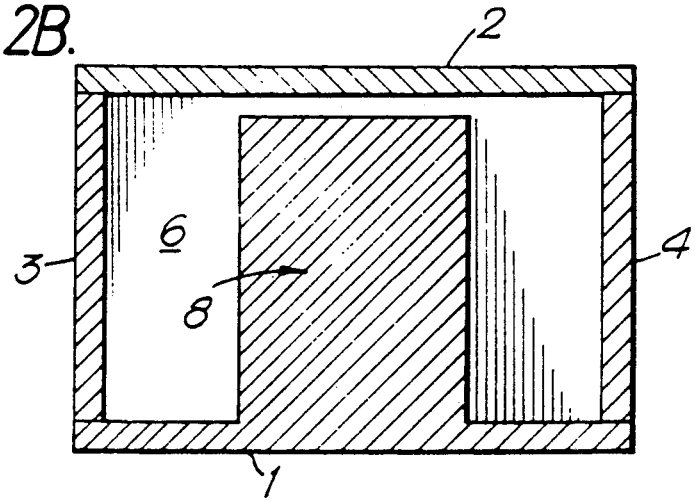
Figure 2C:
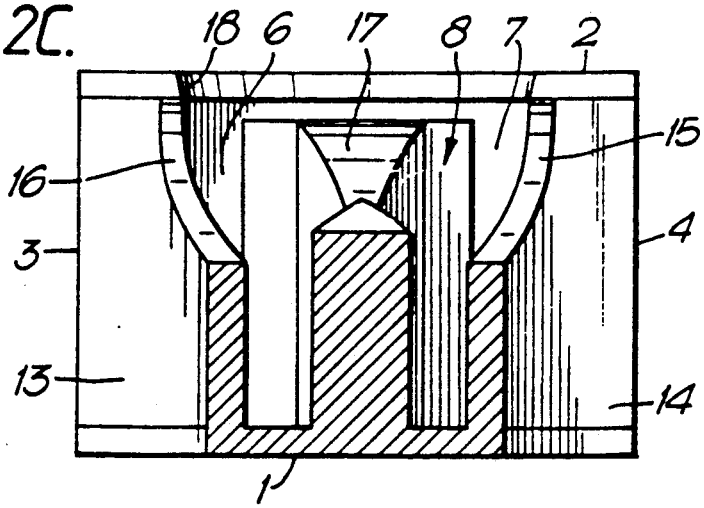
Figure 3:
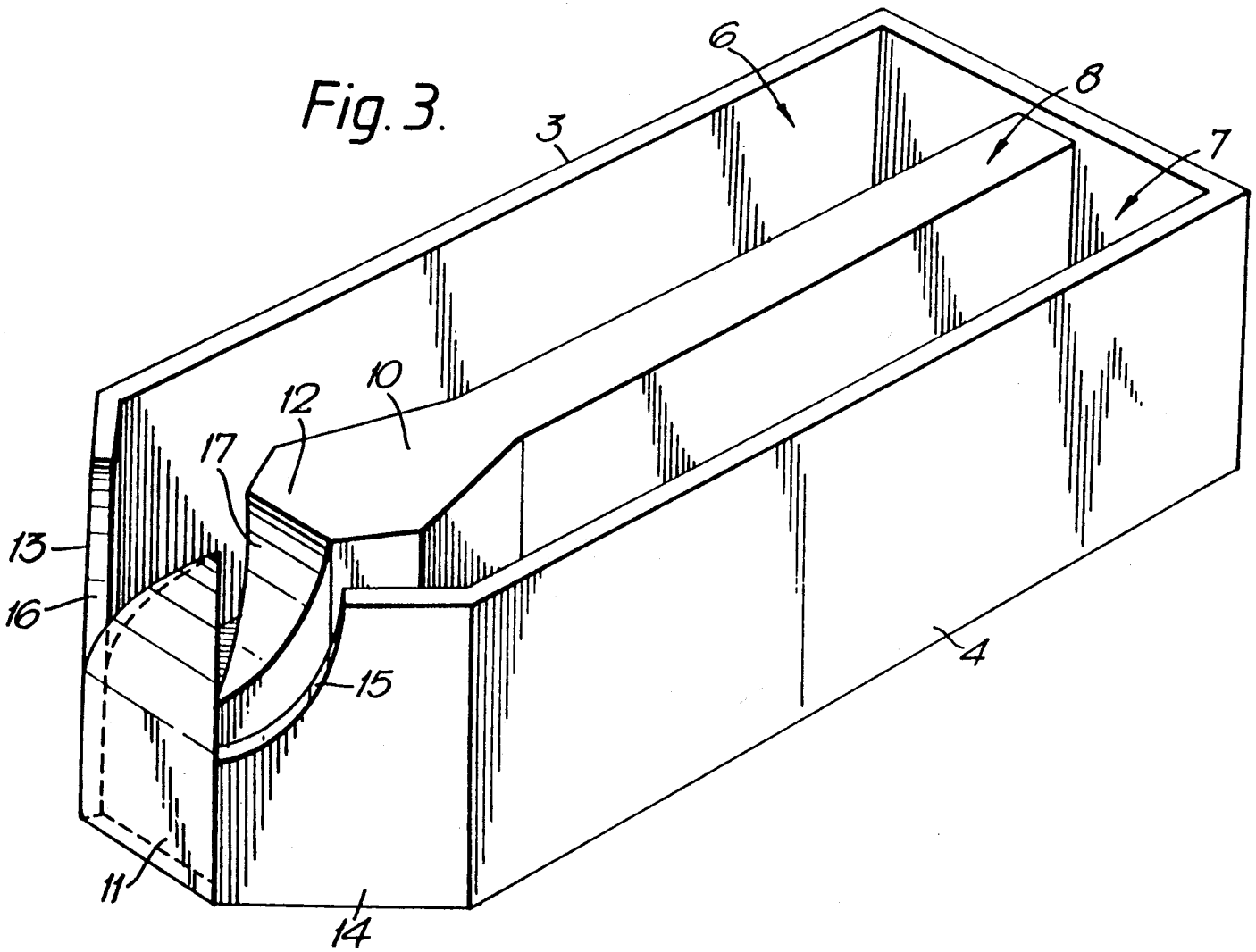
FIG. 3 is perspective view of the magazine of FIG. 1.
Figure 4:
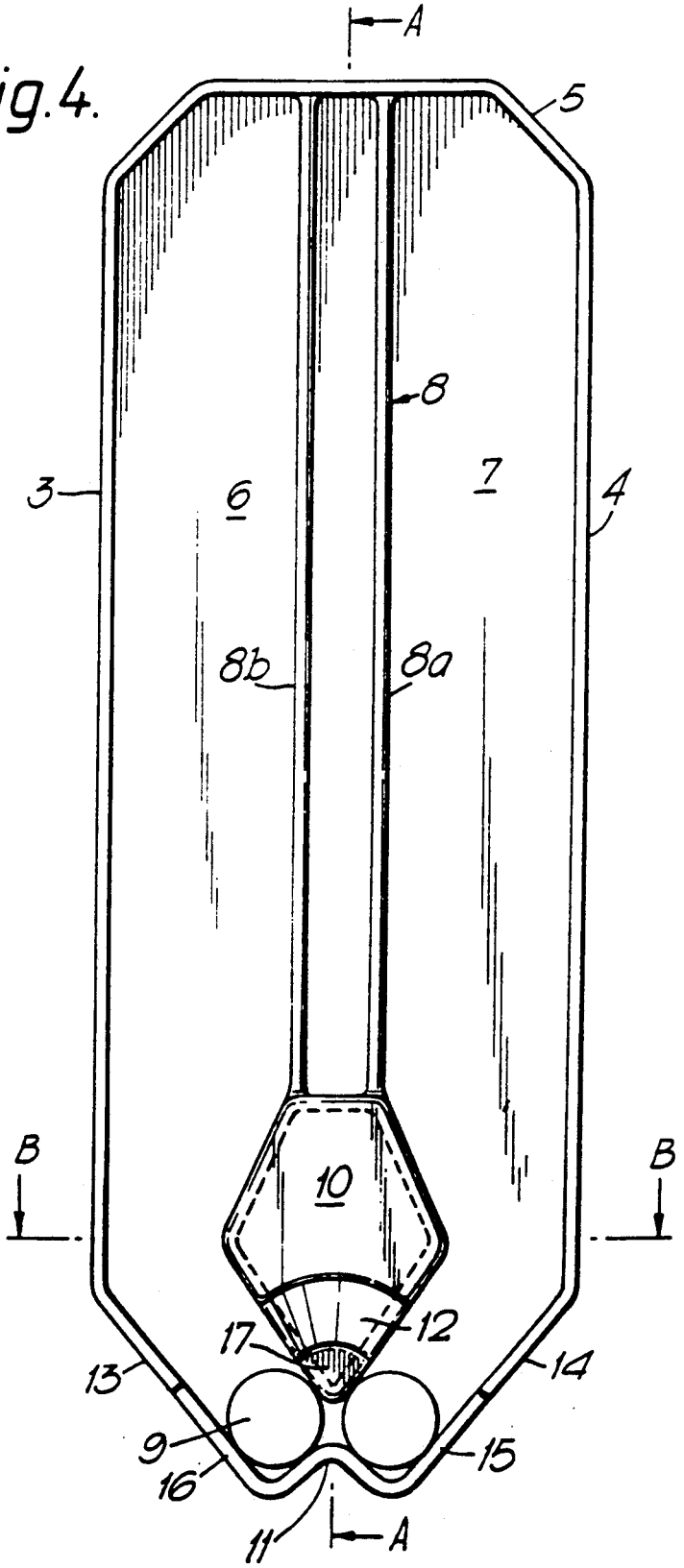
FIG. 4 is a plan view of another magazine of the invention.
Figure 5A:
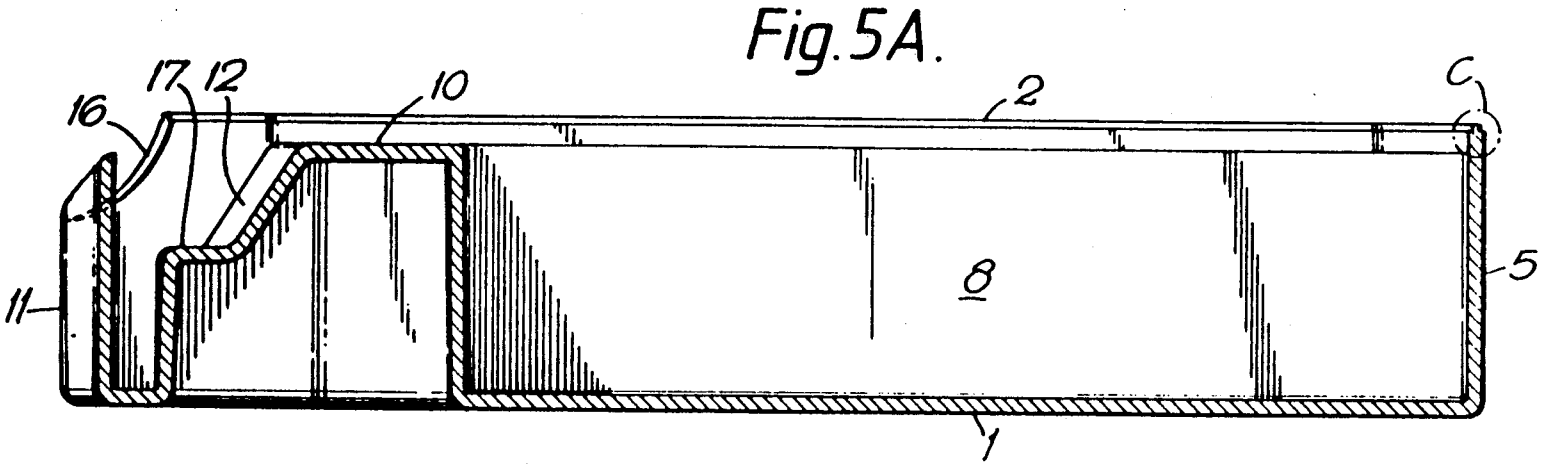
FIG. 5 is a sectional view taken along line A—A of FIG. 4.
FIG. 5B is a sectional view taken along line B—B of FIG. 4.
FIG. 5C is a sectional view, on an enlarged scale, of the circled portion C of FIG. 5A.
Figure 5C:
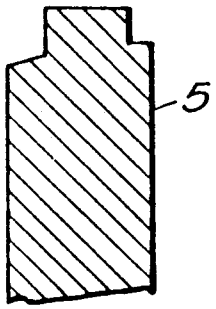
Figure 5B:
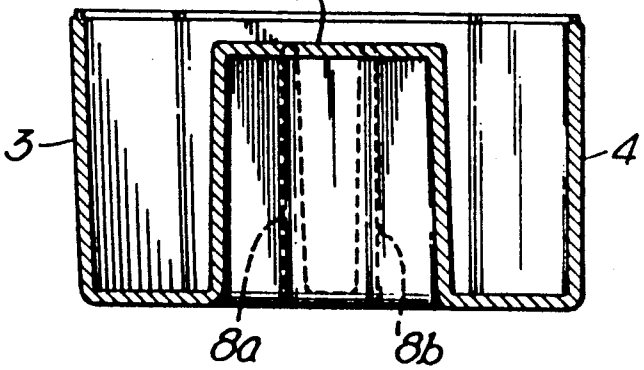
Figure 6:
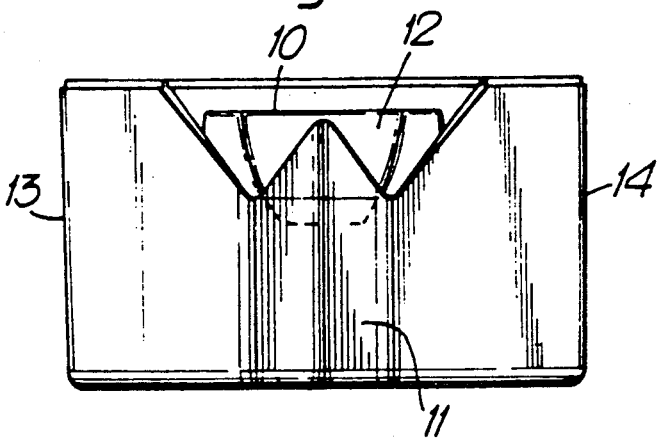
FIG. 6 is an end view of the magazine of FIG. 4.
Figure 8:
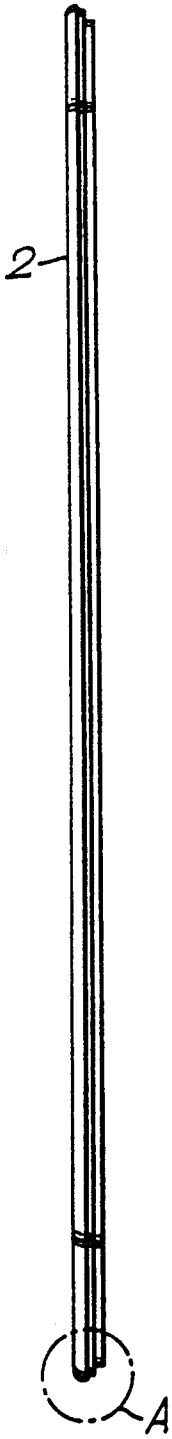
FIG. 8 is a sectional view of the lid of FIG. 7.
Figure 8A:
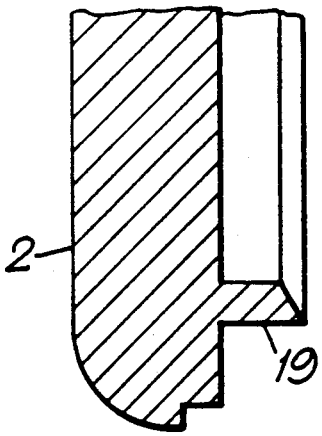
FIG. 8A is a sectional view, on an enlarged scale, of the circled portion A of FIG. 8.
Figure 7:
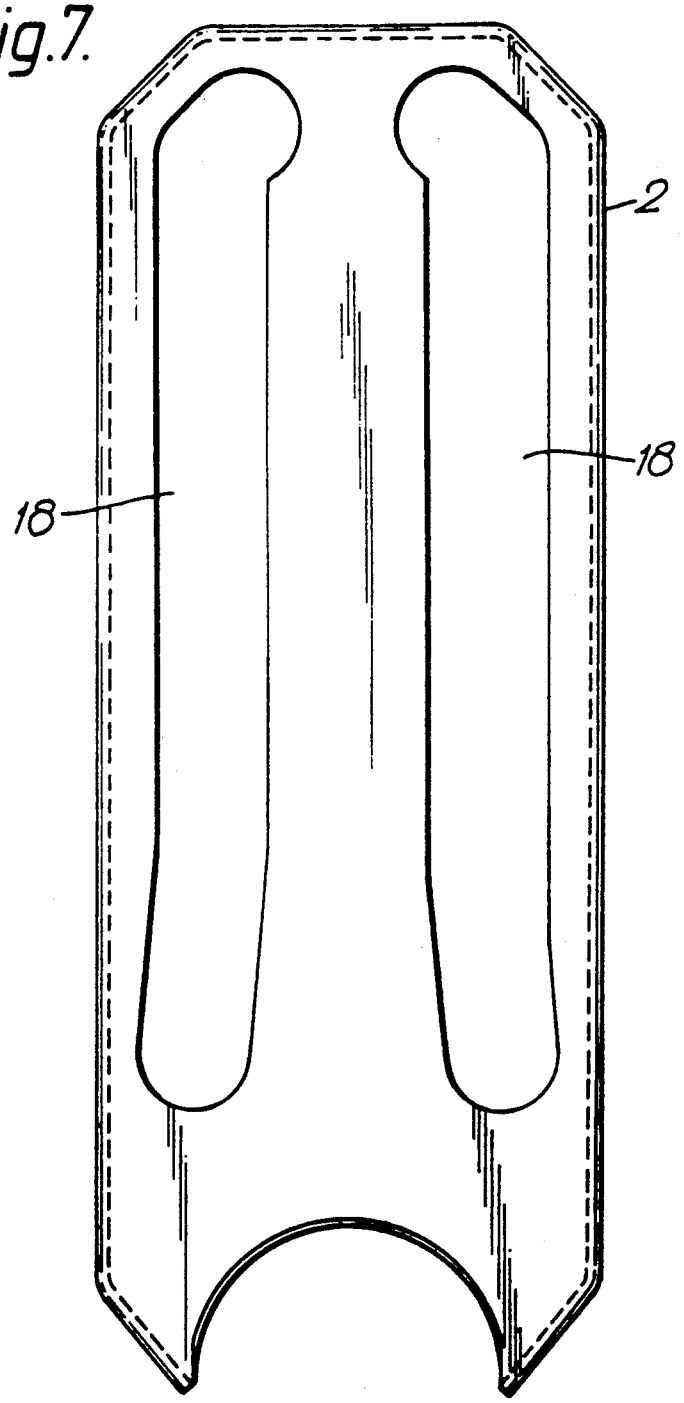
FIG. 7 is a plan view of a lid for the magazine of FIG. 4.

Referring to FIG. 1 to 3 of the drawings, the magazine consists of a box-like structure having a base 1, a lid 2, two sides 3 and 4 and an upper end 5, the box being divided into two channels 6 and 7 by a partition 8. Each of the channels 6 and 7 is suitable to hold two columns of cartridges 9, such as shot gun cartridges, in a staggered manner as shown in FIG. 1. In the event that the cartridges are rimmed cartridges, the rims of the cartridges extend over the top of the partition 8.

At its lower end, the partition 8 has a widened portion 10 and a narrowed portion 12 so that each channel 6 and 7 has a neck allowing one cartridge of the staggered column of cartridges to pass, under the effect of gravity, to the lower end 11 of the box-like structure, into a channel between the narrowed portion 12 of the partition 8 and tapering sides 13 and 14 of the box-like structure, when the magazine is held in the position shown in FIG. 1.

The tapering sides 13 and 14 have cut-out portions 15 and 15, the lower end of the partition 8 has a cut-out portion 17, and the lower end 11 of the magazine is cut away, thereby allowing two cartridges, one from each channel, to be easily removed simultaneously by the user, for loading into a double-barrel shot gun. The magazine is provided with a suitable strap (not shown) or belt loop (not shown) so that it can be carried around the neck, shoulder or waist of the user with the end 11 lowermost, so that the cartridges feed by gravity in pairs to the lower end 11 for simultaneous removal by the user. Alternatively, the user can of course remove a single cartridge from one channel.

In order to prevent the cartridges from falling out of the magazine, the magazine is provided with the lid 2, connected to one of the sides 3 and 4 or to the end 5 in a hinged manner (not shown) and held in place by a suitable fastening means (not shown) such as a hook-and-loop type fastening (e.g. VELCRO). The lower edge of the lid 2 is shown by the dotted line 18 in FIG. 1.

Referring to FIGS. 4 to 8, the magazine shown in these Figures is similar to that shown in FIGS. 1 to 3, and similar parts have been given similar reference numerals. The main difference is that the lid 2 is provided with slots 18 through which the cartridges can be loaded into the magazine (accordingly, it is not necessary for the lid 2 to be hinged to the magazine). The slots 18 are shaped and located so that they prevent the cartridges, of the double column of cartridges in each channel, from escaping once they have been inserted correctly, at any point of the slots, and have taken up their positions on either side of the slot. The lower portion of the slots veer outwardly, following the center line of the channel as it narrows, stopping at a point just above the point where the cartridges form a single column, and out of phase with the cartridges resting one upon the other at this point, so that the cartridges are not held on the lower semicircular rim of the slots. Alternatively, the slots can be narrowed at the portion where the double column of cartridges becomes a single column. This narrowed portion can extend to the lower edge of the lid, along the center line of the channel.

The slots in the lid are elongated so that a cartridge may be inserted through the slots at any point and it is possible therefore for the cartridge being introduced to be inserted just above the uppermost cartridge of those remaining in the magazine. In this way, it takes up a correct position in the channel and does not interrupt the flow of cartridges through the channel. The effect of these slots is that the magazine need never become empty in use as loose cartridges can be inserted and the magazine topped up or refilled without the necessity of taking it off or opening a lid. This can be accomplished with one hand while holding a gun in the other and indeed without looking at the magazine at all.

In an alternative embodiment the lid 2 can be permanently attached to the body of the magazine by any practical means such as ultrasonic welding or glue if made of plastic, or can be made as an integral part of the magazine if the magazine is milled or routed from a solid block of metal or wood.

The lid 2 has therearound a lip 19 for assisting in locating it on the magazine.

The magazine shown in FIGS. 4 to 8 differs from that shown in FIGS. 1 to 3 also in that the partition 8, rather than being a solid partition, consists of two partition walls 8*a* and 8*b* separated by a gap.

The magazine is made in any suitable material such as metal, wood or a plastic material. In the latter case, it may be made by injection moulding. The lid 2 is preferably made of a transparent material.

In the embodiment shown, each channel holds two columns of cartridges. However, it would be possible to modify the magazine so that each channel has a single column of cartridges or more than two columns of cartridges. The length of the magazine can be adapted to the desired number of cartridges.

The magazine can be suitably adapted to take cartridges of various gauges and calibers, and of various types, e.g. of rimmed type, of rimless type, of semi-rimmed type, and of belted rimless type.

I claim:

1. A cartridge magazine for holding a plurality of cartridges for ready access by a user of the cartridge magazine, the magazine comprising:

a box-like structure defining an inner cavity for receiving a plurality of cartridges, the box-like structure having a top and a bottom and a front and a back, the cavity providing an unobstructed path for a plurality of cartridges to move from the top to the bottom of the cavity solely by force of gravity;

first and second troughs defined at the bottom of the box-like structure and in communication with the inner cavity, each trough being configured to receive one cartridge and to prevent a cartridge from falling out of the cavity by force of gravity, the troughs being spaced from each other a predetermined distance that allows two cartridges received therein to be simultaneously grasped by a single hand of a user;

means on the box-like structure for allowing simultaneous removal of two cartridges in the first and second troughs by a single hand of a user; and means for manipulating a pair of cartridges into a parallel spaced relationship proximate the bottom of the box-like structure comprising a partition having a widened portion and a narrowed portion proximate the bottom of the box-like structure, the widened portion being above and adjacent to the narrowed portion and the box-like structure having a tapered lower portion, the widened portion of the partition along with the narrowed portion of the partition in cooperation with the tapered lower portion of the box-like structure forming a pair of necks that each manipulate the cartridges into a single substantially non-staggered column of cartridges, the necks converging toward each other proximate the bottom of the box-like structure.

2. A cartridge magazine for holding a plurality of cartridges for ready access by a user of the cartridge magazine, the magazine comprising:

a box-like structure defining an inner cavity for receiving a plurality of cartridges, the box-like structure having a top and a bottom and a front and a back, the cavity providing an unobstructed path for a plurality of cartridges to move from the top to the bottom of the cavity solely by force of gravity;

first and second troughs defined at the bottom of the box-like structure and in communication with the inner cavity, each trough being configured to receive one cartridge and to prevent a cartridge from falling out of the cavity by force of gravity, the troughs being spaced from each other a predetermined distance that allows two cartridges received therein to be simultaneously grasped by a single hand of a user; and a truncated portion of the bottom of the box-like structure and a truncated portion of the bottom of the front of the box-like structure for allowing simultaneous removal of two cartridges in the first and second troughs by a single hand of a user.

3. A cartridge magazine for holding a plurality of cartridges for ready access by a user of the cartridge magazine, the magazine comprising:

a box-like structure defining an inner cavity for receiving a plurality of cartridges, the box-like structure having a top and a bottom and a front and a back, the cavity providing an unobstructed path for a plurality of cartridges to move from the top to the bottom of the cavity solely by force of gravity;

first and second troughs defined at the bottom of the box-like structure and in communication with the inner cavity, each trough being configured to receive one cartridge and to prevent a cartridge from falling out of the cavity by force of gravity, the troughs being spaced from each other a predetermined distance that allows two cartridges received therein to be simultaneously grasped by a single hand of a user;

means on the box-like structure for allowing simultaneous removal of two cartridges in the first and second troughs by a single hand of a user; and an elongated slot in one of the front and the back of the box-like structure, the slot being vertically oriented along at least a portion of the cavity for allowing loading of cartridges into the cavity.

4. A cartridge magazine for holding a plurality of cartridges for ready access by a user of the cartridge magazine, the cartridge magazine comprising:

a box-like structure defining an inner cavity for receiving a plurality of cartridges, the box-like structure having a top and a bottom and a front and a back, the cavity providing an unobstructed path for a plurality of cartridges to move from the top to the bottom of the cavity solely by force of gravity;

a partition extending at least part way between the top and the bottom of the box-like structure dividing the inner cavity into two elongate channels, each channel being of a width sufficient to hold at least one column of cartridges aligned horizontally and lengthwise from the front to the back of the box-like structure;

the bottom of the box-like structure defining a trough at the bottom of each channel for receiving a single cartridge therein and for preventing a cartridge form falling from the cavity by force of gravity, the troughs being spaced from each other a predetermined distance that allows two cartridges received therein to be simultaneously be grasped by a single hand of a user; and means on the box-like structure for allowing the simultaneous removal of two cartridges in the first and second troughs by a single hand of a user.

5. The cartridge magazine of claim 4 further including means for manipulating a pair of cartridges into a parallel spaced relationship proximate the bottom of the box-like structure, the means comprising:

a widened portion and a narrowed portion of the partition proximate the bottom of the box-like structure, the widened portion being above and adjacent to the narrowed portion and the box-like structure having a tapered lower portion, the widened portion of the partition along with the narrowed portion of the partition in cooperation with the tapered lower portion of the box-like structure forming a pair of necks that each manipulate the cartridges into a single substantially non-staggered column of cartridges, the necks converging toward each other proximate the bottom of the box-like structure.

6. The cartridge magazine of claim 4 wherein the means on the box-like structure for allowing simultaneous removal of the cartridges comprise a truncated portion of the bottom of the box-like structure and a truncated portion of the bottom of the front of the box-like structure.

7. The cartridge magazine of claim 4 further including means for allowing loading of cartridges into each of the channels.

8. The cartridge magazine of claim 7 wherein the means for loading cartridges comprises an elongate slot associated with each channel in one of the front and the back of the box-like structure, the slot being vertically oriented along at least a portion of each channel to facilitate loading of cartridges into a partially filled channel.

9. The cartridge magazine of claim 8 wherein an elongate slot is oriented between a staggered columns of cartridges in each channel such that the cartridges fall to one side or the other of the elongate slot and are thereby prevented from escaping from the channel.

* * * * *